US005649375A

United States Patent [19]

Zorzi

[11] Patent Number: 5,649,375

[45] Date of Patent: *Jul. 22, 1997

[54] SEALING DEVICE FOR SKI BOOTS

[75] Inventor: Claudio Zorzi, Paderno di Ponzano Veneto, Italy

[73] Assignee: Nordica S.p.A., Trevignano, Italy

[ * ] Notice: The term of this patent shall not extend beyond the expiration date of Pat. No. 5,491,910.

[21] Appl. No.: 621,707

[22] Filed: Mar. 26, 1996

Related U.S. Application Data

[63] Continuation of Ser. No. 451,900, May 26, 1995, abandoned, which is a continuation of Ser. No. 320,592, Oct. 11, 1994, Pat. No. 5,491,910, which is a continuation of Ser. No. 69,800, Jun. 1, 1993, abandoned.

[30] Foreign Application Priority Data

Jun. 16, 1992 [IT] Italy ..... TV92U0036

[51] Int. Cl.[6] ..... A43B 5/04

[52] U.S. Cl. ..... 36/117.1; 36/50.1; 36/50.5

[58] Field of Search ..... 36/117–121, 54, 36/50.1, 50.5, 4; 24/68 SK, 69 SK, 70 SK, 71 SK

[56] References Cited

U.S. PATENT DOCUMENTS 5,491,910 2/1996 Zorzi ..... 36/117

*Primary Examiner*—Ted Kavanaugh

*Attorney, Agent, or Firm*—Guido Modiano; Albert Josif

[57] ABSTRACT

Sealing device, particularly usable for ski boots including a shell provided with a first inner flap and with a second outer flap which can mutually overlap. The sealing device is constituted by a single body including a band which can be arranged below the second flap and from which a wing protrudes upward. The wing is arranged adjacent to the lower surface of the second flap and interacts with the upper surface of the first flap. Since the band and the wing are both resilient, perfect tightness to infiltrations between the flaps is achieved when the first and second flaps are made to overlap.

10 Claims, 2 Drawing Sheets

SEALING DEVICE FOR SKI BOOTS

This is a continuation application of application Ser. No. 08/451,900 filed May 26, 1995, now abandoned, which is a continuation application of application Ser. No. 08/320,592 filed Oct. 11, 1994, now U.S. Pat. No. 5,491,910, which is a continuation of application Ser. No. 08/069,800 filed Jun. 1, 1993, now abandoned.

BACKGROUND OF THE INVENTION

The present invention relates to a sealing device particularly usable in ski boots comprising a shell provided with overlapping flaps.

The need to limit water infiltration inside the ski boot shell during sports practice is strongly felt. It has in fact been observed that the overlap of the flaps is never such as to eliminate water infiltrations inside the boot.

The flaps are in fact made of relatively rigid material and are subject, during use, to mutual sliding movements which form small gaps especially along the corners of the flaps.

In order to obviate these drawbacks it is known to apply, especially at the transverse edges of the flaps, a pad made of rubber or plastics, the purpose of which is to create a mechanical obstacle to the passage of water from the tip to the flaps during sports practice.

Sealing devices are also known which are constituted by two separate inserts separately applied on different edges of the flaps of the shell; one of the two inserts can be arranged at a longitudinal edge of a flap.

The second insert is in turn constituted by two parts: one can be inserted at the transverse edges of the flaps of the shell, and the other part is associable transversely to the first part toward the tip of the boot.

Even this known solution, described in the Italian patent no. 1,039,942 filed on Jul. 18, 1975, has drawbacks: first of all three components are involved which must be partially assembled together and to the shell, and furthermore the interaction of all of these components with each other and with the flaps does not ensure optimum watertightness between them in any case.

U.S. Pat. No. 3,597,862 discloses a ski boot having a waterproof bat tongue 57 which is however interacting only with the edges of the flaps.

SUMMARY OF THE INVENTION

The aim of the present invention is therefore to eliminate the drawbacks described above in known types by providing a sealing device which allows optimum tightness to water infiltrations on ski boots which comprise a shell provided with overlapping flaps.

Within the scope of the above aim, an important object is to provide a sealing device which is structurally simple and easy to apply to the boot.

Another important object is to provide a sealing device which is reliable and safe in use and does not substantially increase the thicknesses of the boot at the overlapping flaps.

This aim, these objects and others which will become apparent hereinafter are achieved by a sealing device for ski boots including a shell provided with a first inner flap and with a second outer flap which can mutually overlap, characterized in that it comprises a single body constituted by a band, said band being arranged either below or above said first flap and being arranged below said second flap and protruding from said flaps toward the tip of said boot; a wing protruding upward from said band being arranged adjacent to a lower surface of said second flap and interacting with an upper surface of either said first flap or said band, said band and said wing being resilient.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
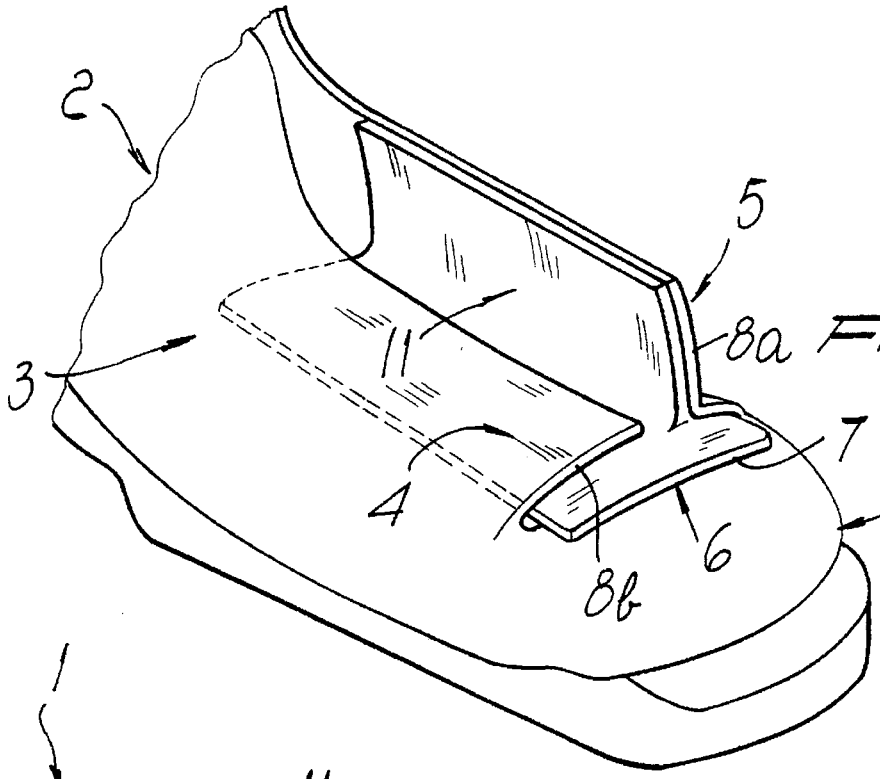
FIG. 1 is a partial perspective view of a ski boot showing the sealing device at the shell with overlapping flaps, in the condition in which said flaps are open.
Figure 2:
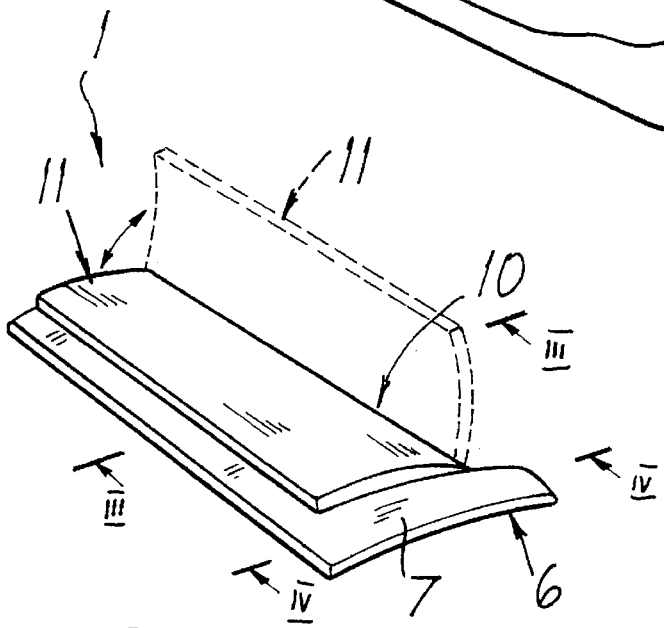
FIG. 2 is a perspective detail view of the sealing device.
Figure 3:
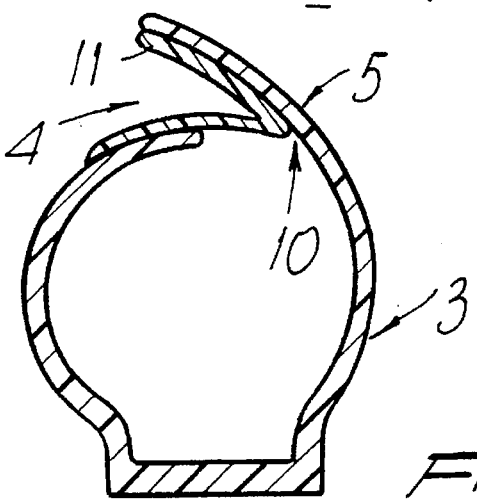
FIG. 3 is a sectional view, taken along the plane III—III of FIG. 2, with the sealing device applied at the shell.

With reference to the above figures, the numeral 1 designates the sealing device, which is particularly usable in ski boots 2 which comprise a shell 3 provided with a first inner flap 4 and with a second outer flap 5 which can mutually overlap.

The sealing device 1 is constituted by a single body comprising a band 6, made of resilient material, which can be arranged below both the first flap 4 and the second flap 5. The band is substantially rectangular and has such a width as to fit entirely below the flap 4 and partially below the second flap 5.

The band 6 is provided with an end 7 which protrudes beyond the transverse perimetric edges 8*a* and 8*b* of the first and second flaps toward the tip 9 of the shell 3. As seen in FIG. 1, the flaps 4 and 5 are arranged adjacent mutually opposite sides of an opening in the shell 3 of the boot 2. The opening includes in particular a transverse portion, corresponding to the transverse perimetric edges 8*a* and 8*b* and extending transversely to the longitudinal extension of the shell which extends rearwardly from the tip 9, and a longitudinal portion extending substantially along the shell longitudinal extension from the transverse portion.

The width of the end 7 is equal to the distance between the points where the first and second flaps couple to the shell.

The end 7 is therefore wider than the band 6, so that it is partially arranged below the transverse perimetric edges 8*a* and 8*b* of the first and second flaps.

Figure 4:
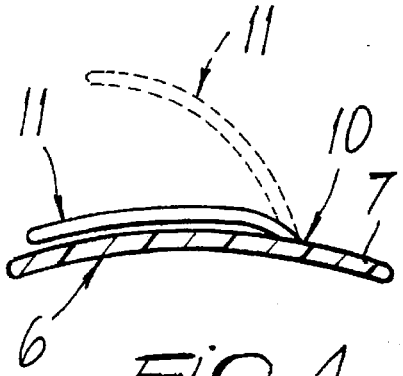
FIG. 4 is a sectional view, taken along the plane IV—IV of FIG. 2.

A wing 11 extends upward from the band 6 at the longitudinal folding edge between the band 6 and the wing 11 partially located below the second flap 5; said wing 11 is also made of resilient material and is associable, for example by glueing, with the lower lateral surface of the overlying second flap 5. FIG. 4 illustrates the relative bending movement along the folding edge 10 between the wing 11 and the band 6.

Said wing 11 thus interacts at the outer lateral surface of the first flap 4 once the first and second flaps have been made to mutually overlap.

The use of the invention is in fact as follows: once the band 6 has been associated below the first and second flaps, so that the end 7 protrudes beyond the transverse perimetric edges 8*a* and 8*b* of said first and second flaps, and once the wing 11 has been arranged at the inner lateral surface of the second flap 5, fastening of the flaps produces a seal along the transverse and longitudinal perimetric edges of said flaps.

Water penetration is in fact not possible, because the sealing device affects all the regions in which the flaps overlap each other and the shell.

It has thus been observed that the invention has achieved the intended aim and objects, a sealing device having been obtained which is structurally very simple, is easy to apply to the shell and allows to achieve optimum tightness against water infiltration.

Even any sliding movements of the flaps do not alter this condition, by virtue of the shape of the band 6, of the end 7 and of the wing 11.

Figure 5:
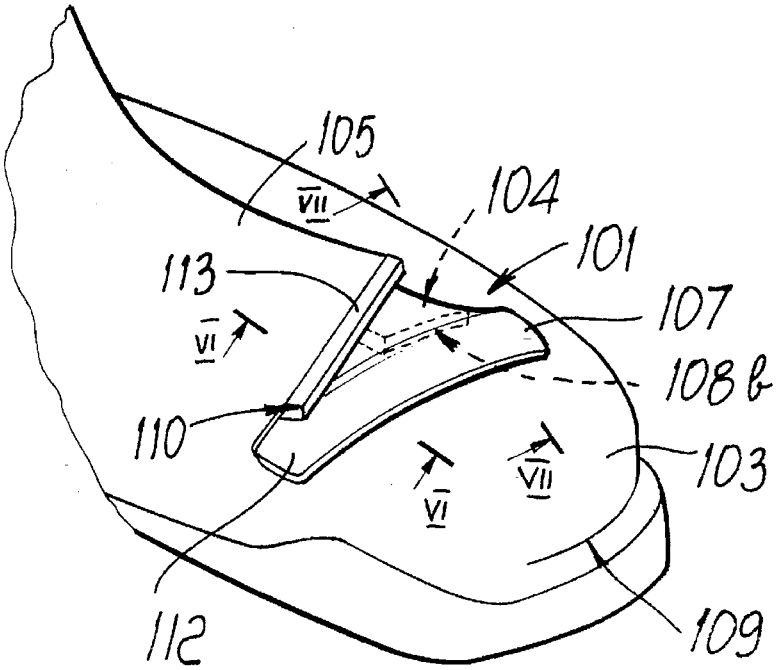
FIG. 5 is a lateral perspective view of a ski boot having a different arrangement of the band.
Figure 6:
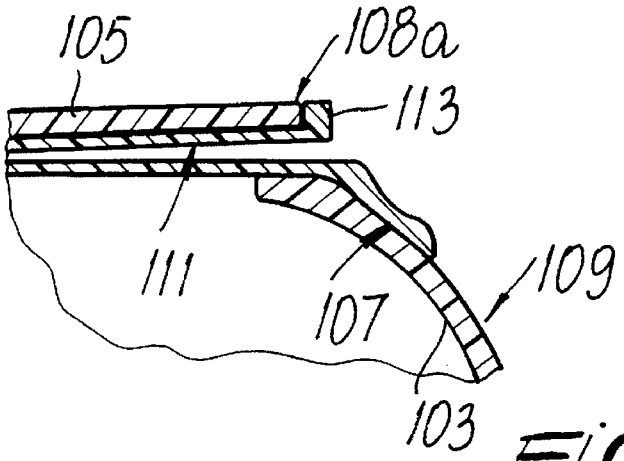
FIG. 6 is a sectional view, taken along the plane VI—VI of FIG. 5.
Figure 7:
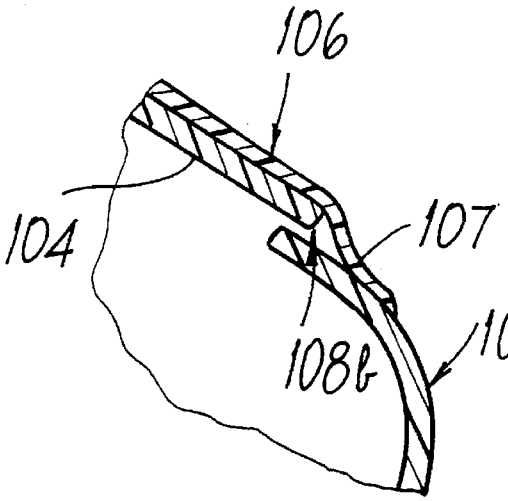
FIG. 7 is a sectional view, taken along the plane VII—VII of FIG. 5.

FIGS. 5 to 7 illustrate a further embodiment of the sealing device 101, which is constituted by a single body comprising a band 106, made of resilient material, which can be arranged above the first flap 104 and below the second flap 105.

Said band 106 is essentially rectangular, with such a width as to fully surmount the first flap 104 and arrange itself partially below the second flap 105.

The band 106 has an end 107 which protrudes beyond the transverse perimetric edges 108*a* and 108*b* of the first and second flaps toward the tip 109 of the shell 103.

The end 107 is wider than the distance between the points where the first and second flaps couple to the shell: it thus fully surmounts the transverse perimetric edge 108*b* of the first flap 104, from which it blends with the underlying shell 110, and protrudes beyond the point 103 where the second flap 105 couples to the shell, forming a lip 112 which is blended with the shell 103.

The wing 111 is instead associated below the second flap 105 and has, at the transverse perimetric edge 108*a* of said flap, a step-like raised portion 113 which abuts against said flap and is thus suitable to increase watertightness.

Naturally, the length of the band, of the wing, of the lip and the height of the step-like raised portion may be the most appropriate according to the specific requirements.

The materials and the dimensions which constitute the individual components of the sealing device may naturally also be the most appropriate according to the specific requirements.

I claim:

1. A combination of a boot with an opening and a sealing device for sealing the opening of the boot, said boot comprising;

a shell having an inside and being adapted for surrounding a user's foot, said opening extending in said shell;

a first flap of said shell positioned adjacent said opening at one side of the opening; and a second flap of said shell positioned adjacent said opening at another side of the opening;

wherein said first and second flaps are mutually relatively movable between a closed position in which said first and second flaps are relatively closed and arranged mutually adjacent for closing said opening and blocking a user's foot in the inside of the shell and an open position in which said first and second flaps are relatively open and arranged spaced apart for allowing access to said inside of the shell, and wherein said first flap has an inner side directed towards the inside of the shell in said closed position and an outer side directed away from the inside of the shell in said closed position, and wherein said second flap has an inner side directed towards the inside of the shell in the closed position and an outer side directed away from the inside of the shell in the closed position;

and wherein said sealing device is arranged at said opening of said shell and comprises;

a single body made of resilient material;

a band of said single body;

a wing of said single body; and a folding edge of said single body at which said band and said wing are mutually connected such that said band and said wing are mutually relatively bendable along said folding edge;

wherein said band is connected to said first flap and said wing is connected to said second flap such that said band is movable together with said first flap and said wing is movable together with said second flap as said first and second flaps mutually relatively move between said open and closed positions and such that said band and said wing mutually relatively bend along said folding edge as said first and second flaps mutually relatively move between said open and closed positions;

and wherein said wing has an outer surface directed away from the inside of the shell in said closed position and an inner surface directed towards the inside of the shell in said closed position, a portion of said outer surface being connected to a portion of said inner side of said second flap such that said portion of said outer surface of said wing and said portion of the inner side of said second flap remain mutually invariably connected in all positions which said first and second flaps assume as said first and second flaps mutually relatively move between said open and closed positions;

and wherein said band has an outer surface directed away from the inside of the shell in said closed position and an inner surface directed towards the inside of the shell in said closed position, a portion of one of said outer surface and said inner surface of said band being connected to a portion of one of respectively said inner side and said outer side of said first flap such that said portion of one of said outer surface and said inner surface of said band and said portion of one of respectively said inner side and said outer side of said first flap remain mutually invariably connected in all positions which said first and second flaps assume as said first and second flaps mutually relatively move between said open and closed positions.

2. The combination of claim 1 wherein said portion of one of said outer surface and said inner surface of said band is a portion of said outer surface of said band, and wherein a portion of one of respectively said inner side and said outer side of said first flap is a portion of said inner side of said first flap.

3. The combination of claim 2 wherein at least a portion of said second flap overlies at least a portion of said first flap with respect to the inside of said shell in said closed position, and wherein said inner surface of said wing rests against said outer side of said first flap.

4. The combination of claim 1 wherein said portion of one of said outer surface and said inner surface of said band is a portion of said inner surface of said band, and wherein a portion of one of respectively said inner side and said outer side of said first flap is a portion of said outer side of said first flap.

5. The combination of claim 4 wherein at least a portion of said second flap overlies at least a portion of said first flap with respect to the inside of said shell in said closed position, and wherein said inner surface of said wing rests against said outer surface of said band.

6. The combination of claim 1 wherein said shell includes a tip and a longitudinal extension extending rearwardly from said tip, and wherein said opening includes a transverse portion extending substantially transversely to said longitudinal extension and a longitudinal portion extending rearwardly substantially along said longitudinal extension of said shell from said transverse portion, and wherein said single body of said sealing device further comprises a protruding end arranged over said shell at a portion of said shell between said tip and said transverse portion of said opening.

7. The combination of claim 6 wherein said protruding end has a transverse extension extending substantially transversely to said longitudinal extension of said shell and extending laterally with respect to said folding edge between said wing and said band.

8. The combination of claim 1 wherein said shell includes a tip and a longitudinal extension extending rearwardly from said tip, and wherein said opening includes a transverse portion extending substantially transversely to said longitudinal extension and a longitudinal portion extending rearwardly substantially along said longitudinal extension of said shell from said transverse portion, and wherein said second flap includes a transverse perimetric edge arranged in correspondence with said transverse portion of said opening, and wherein said single body of said sealing device further comprises a step-like raised portion of said wing arranged in frontal abutment with said transverse perimetric edge of said second flap.

9. The combination of claim 8 wherein said single body of said sealing device further comprises a protruding end arranged over said shell at a portion of said shell between said tip and said transverse portion of said opening.

10. The combination of claim 9 wherein said protruding end has a transverse extension extending substantially transversely to said longitudinal extension of said shell and extending laterally with respect to said folding edge between said wing and said band.

* * * * *